United States Patent [19]

Hiraoka et al.

[11] 4,127,336

[45] Nov. 28, 1978

[54] TYPE HEADS

[75] Inventors: Yuji Hiraoka, Kodaira; Yodo Kageyama, Tokorozawa, both of Japan

[73] Assignee: Nippon Telegraph and Telephone Public Corporation, Tokyo, Japan

[21] Appl. No.: 772,479

[22] Filed: Feb. 28, 1977

[30] Foreign Application Priority Data

Mar. 8, 1976 [JP] Japan ..... 51-25260

[51] Int. Cl.[2] ..... B41J 1/30

[52] U.S. Cl. ..... 400/144.2; 400/174

[58] Field of Search ..... 197/53, 54, 18, 6.6; 101/93.15, 93.16, 93.17, 93.19

[56] References Cited

U.S. PATENT DOCUMENTS

| | | | |
|---|---|---|---|
| 2,127,514 | 8/1938 | Hausman | 197/53 X |
| 3,566,782 | 3/1971 | Kocher | 197/53 X |
| 3,859,712 | 1/1975 | Tramposch | 197/53 X |
| 3,884,340 | 5/1975 | Tramposch et al. | 197/53 |
| 3,921,277 | 11/1975 | Tramposch | 197/53 X |
| 3,921,784 | 11/1975 | Orlens | 197/54 |
| 3,983,985 | 10/1976 | Guerrini et al. | 197/53 |
| 3,990,562 | 11/1976 | Goto et al. | 197/53 |
| 4,018,639 | 4/1977 | Staples | 197/53 X |

*Primary Examiner*—Paul T. Sewell

*Attorney, Agent, or Firm*—Schatzel & Hamrick

[57] ABSTRACT

The type head comprises a hub mounted on the shaft of a drive motor, an annular rim concentric with the hub and connected thereto through a plurality of radial spokes, a plurality of supporting arms extending from the outer periphery of the annular rim and type units mounted on the outer ends of respective supporting arms.

10 Claims, 5 Drawing Figures

TYPE HEADS

BACKGROUND OF THE INVENTION

This invention relates to a type head and more particularly to a type head for use in a motor-controlled impact serial printer in which a plurality of type units are arranged on a circle.

Most of the prior art impact serial printer are mechanical printers in which the printing operation is performed by distributing a common power among type unit selection, line feed and other control operations by using such complicated and precise mechanical elements as cams, levers, clutches, etc. However, such mechanical printers are not advantageous from the standpoints of their operating speed, weight and price so that it is a recent trend to substitute motor-controlled impact serial printers for the mechanical printers. This invention is directed to the motor-controlled impact serial printers wherein the various printing operations described above are performed directly by individual control motors.

The type heads which have been used in the prior art motor-controlled impact serial printers can be classified into boxed type heads, and petal or daisy type heads. In the former, each of a plurality of type units is movably contained in each of a plurality of openings provided in a rigid casing, and the back of a selected type unit is hit by a printing hammer at the time of printing thereby printing a charactor on paper disposed in front of the type unit. Since each such type unit is operated independently of adjacent type units, side printing can be positively prevented. However, there are many sliding surfaces which become worn, and as a result the reliability of the boxed type head is low. Moreover, as there are a number of component parts, it requires a complicated assembling operation thus increasing the cost of manufacturing. As shown in FIG. 1, in the daisy type head a plurality of type supporting arms 13 having the same length and extending in the radial direction are secured to a hub 12 mounted on the rotary shaft of a control motor, and a type unit 14 is integrally mounted on the outer end of each supporting arm. In such device, the printing is performed by striking a selected type head by a printing hammer so to flex the supporting arm. The daisy type head has a simpler construction and requires a lesser number of component parts than the box type and is thus highly suited for mass production. However, since the daisy type units are arranged in a plane, the rotational moment of inertia increases as the square of the number of type units. For this reason, there is a limit on the number of the type units. For example, the printer presently used most widely utilizes less than 96 characters.

Where it is necessary to use at least 128 characters, for example, as in the case of type units having Japanese characters, the rotational moment of inertia increases greatly, thereby requiring that the operating speed be decreased. Further, when the number of the type units increase, the length of the supporting arms increase thus creating undesirable vibrations (resonance) resulting in the degradation of the quality of the printed matter. Where the type head is manufactured with plastics, as the number of the type units increases, it is necessary to use complicated and precise metal molds. Such metal molds have a relatively short life and are thus not suitable for mass production. Although it is possible to mount a plurality of type units on each supporting arm without increasing the length thereof, such construction is likely to cause side printing.

SUMMARY OF THE INVENTION

Accordingly, it is the principal object of this invention to provide an improved type head capable of preventing side printing even when a large number of the type units are mounted while preserving the advantage of producing high quality printed matters inherent to the prior art daisy type head.

Another object of this invention is to provide a type head capable of reducing the rotational moment of inertia.

Still another object of this invention is to provide an improved rotary type head having a long operating life.

A further object of this invention is to provide an improved rotary type head having a simple construction suitable for mass production. According to this invention there is provided a type head comprising a hub, an annular rim encircling the hub in a concentric relationship, a plurality of equally spaced radial spokes interconnecting the hub and the annular rim, a plurality of supporting arms radially extending from the annular rim, and type units mounted on the outer ends of the respective supporting arms.

DESCRIPTION OF THE PREFERRED EMBODIMENTS

Figure 2:
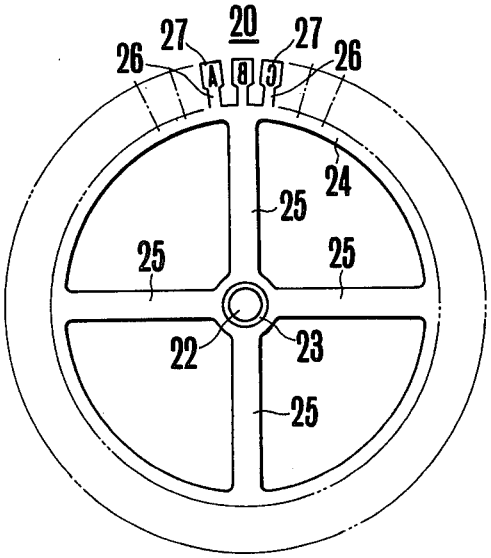
FIG. 2 is a front view showing a daisy type head embodying the invention.

FIG. 2 shows one example of the daisy type head 20 embodying the invention. The type head 20 comprises a hub 23 provided with an opening 22 and adapted to be mounted on a shaft coupled directly or through a reduction gearing to the shaft of a driving motor, not shown. The type head further comprises an annular rim 24 concentric with the hub 23 and connected thereto through four radial spokes 25.

A number of relatively short radial supporting arms or fingers 26 are formed about the periphery of the rim 24 at a definite spacing and a type unit 27 including a European alphabet, numerical digit or Japanese character is mounted on the outer end of each supporting arm.

The type head of this invention may be made of aluminum, duralumin, titanium or plastics, or of a combination of metal and plastics. In the latter case, the plastics are used to form the rim, spokes and hub, and the metal is used to form the supporting arms. In the former case, the supporting arms are made integral with a connecting member secured to the annular rim. The plastics which may be used in this invention include a polyacetal resin such as an acetal copolymer, a polyolefin such as a polypropylene, a polyamide such as nylon 66, a polyester such as a polyethylene terephthalate, a thermoplastic resin such as a polyimide, a thermosetting resin such as pheno resin and expoxy resin and mixtures thereof with carbon filaments, glass fibers, polyimide filaments and powders of carbon and a polyimide resin.

The construction described above has the following advantages.

Figure 1:
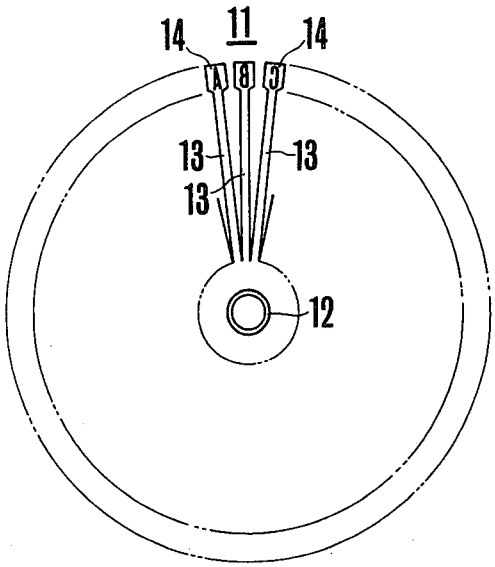
FIG.1 PRIOR ART
FIG. 1 is a front view showing one example of a prior art daisy type head.

(1) Whereas in the prior art construction shown in FIG. 1 the supporting arms for supporting the type units extend in the radial direction from the periphery of the hub, according to this invention the supporting arms extend from the periphery of an annular rim which has a larger diameter than the hub and is arranged concentric therewith. Accordingly, it is possible to select any value for the length of the periphery of the rim which is longer than that of the hub and to mount the supporting arms at a spacing larger than those of the prior art construction even when the number of the type units is increased. For this reason, it is possible to prevent side printing of type units adjacent to a selected type unit.

(2) In the prior art type head shown in FIG. 1, since printing is made by resiliently flexing long supporting arms, after long use the supporting arms undergo plastic deformation due to accumulated fatigue. For this reason, it has been impossible to increase the spacing between the printing paper and the type units beyond a certain limit. To the contrary, according to this invention, because the supporting arms are short and because it is possible to increase the width of the supporting arms, it is possible to select any blending stiffness for the joints between the supporting arms and the rim. Accordingly, it is possible to increase the spacing between the type units and the recording paper to about 2.5 mm for example. Further, due to the increased bending stiffness of the joints it is possible to prevent the undesirable vibration of the supporting arms which causes blurred printing as well as side printing.

(3) According to this invention, any number of the type units can be mounted by varying the diameter of the annular rim. Accordingly, it is necessary to mount only one type unit on one supporting arm regardless of the increased number of the type units. In other words, it is not necessary to mount two type units on each supporting arm and to use complicated transfer mechanisms.

(4) Moreover, since it is possible to use a number of spokes 25 (for example 2 to 5) much smaller than the number of supporting arms, the moment of inertia can be reduced greatly.

(5) This construction simplifies the structure in the area of the hub. Moreover, since the spacing between adjacent supporting arms is wide, the construction and working of the metal mold utilized to prepare the type head are not required to be fine and delicate, thus the life of the mold can be prolonged and the mold can be manufactured by mass production.

Analyzing in more detail the advantages of the type head of this invention, there are many limits for practical type heads. In the following, some of the limits are investigated experimentally. First, the dimension limits for avoiding the problems of side printing, lateral displacement of the type units, and the stress caused by restoring the displaced type unit were determined experimentally by varying the lengths of the supporting arms and the spokes. The following results were obtained using a dynamic experimental device under the indicated conditions.

Type unit: OCR, font B, size I.

$W_F/t_F = 2$ $t_F = t_R = t_S (= 0.5 \text{ mm})$ $W_R/W_F = 1 - 3$ $W_S/W_F = 2 - 8$ where $N_F$: total number of the supporting arms,
$R_S$: radius of the supporting arms, $(= L_F + W_R + L_S + R_H)$,
$W_R$: width of the annular rim,
$R_H$: radius of the hub,
$L_F$: length of the supporting arms,
$L_S$: length of the spokes,
$W_F$: width of the supporting arms
$W_S$: width of the spokes,
$t_F$: thickness of the supporting arms
$t_S$: thickness of the spokes Table 1 below shows the side printing and the stress for various values of the above described parameters.

Table 1

| Number of supporting arms | Radius of the supporting arms | Width of the rim | Radius of the hub | Length of the supporting arms | Length of the spokes | | $L_S/L_F$ / $N_F$ | Result | |
|---|---|---|---|---|---|---|---|---|---|
| $N_F$ | $R_S$ (mm) | $W_R$ (mm) | $R_H$ (mm) | $L_F$ (mm) | $L_S$ (mm) | $L_S/L_F$ | (x $10^{-2}$) | Side printing | Stress |
| | 30.6 | 1.5 | 5 | 5 | 19.1 | 3.8 | 4 | Δ | o |
| 96 | 30.6 | 2 | 8 | 10 | 10.6 | 1.1 | 1.1 | o | o |
| | 30.6 | 1.5 | 5 | 15 | 9.1 | 0.6 | 0.6 | o | Δ |
| | 42 | 1.5 | 5 | 5 | 30.5 | 6.1 | 4.6 | Δ | o |
| 132 | 42 | 2.5 | 12 | 10 | 17.5 | 1.8 | 1.3 | o | o |
| | 42 | 2 | 10 | 20 | 10 | 0.5 | 0.4 | o | o |

Remarks 1. o no problem, Δ limit
2. When the stress created by the displacement and restoration of the type unit does not exceed the fatigue stress of the material, the result is o, whereas when the stress is equal to the fatigue stress, the result is Δ.

Table 1 shows that the ratio of $L_F$ (the length of the supporting arms) to $L_S$ (the length of the spokes) ranges between 0.5 and 6.1 whereas the ratio per supporting arm $L_S/L_F/N_F$ ranges between 0.004 and 0.046 in order to satisfy both the side print and the stress feature.

The minimum bending stiffness of the spokes were determined experimentally from the viewpoint of vibration and stress (those shown in Table 1) and the following results were obtained using a dynamic experimental device under the indicated conditions. Definitions of various terms are the same as above described.

Type unit: OCR, font B, size I $L_F/W_F = 10$ $W_R/W_F = 2.5$ $t_F = t_R = t_S (= 0.5 \text{ mm})$ Printing speed: 30–60 characters/sec.

$J_C < J_D$ where $J_C$: the moment of inertia of the printing head of this invention $J_D$: the moment of inertia of the printing head of the prior art $N_S$: total number of spokes.

The following Table 2 shows the side printing and the stress for various values of the above described parameters.

Table 2

| Number of supporting arms $N_F$ | Number of spokes $N_S$ | Width of spokes $W_S$(mm) | $N_F/N_S \cdot W_S$ | $J_C/J_D$ | Result Vibration | Result Stress |
|---|---|---|---|---|---|---|
| | 2 | 8 | 6.0 | 0.88 | Δ | Δ |
| 96 | 9 | 2 | 5.3 | 0.90 | o | o |
| | 12 | 1.5 | 5.3 | 0.88 | o | o |
| | 2 | 11 | 6.0 | 0.76 | Δ | Δ |
| 132 | 3 | 8 | 5.5 | 0.78 | o | o |
| | 9 | 2.5 | 5.9 | 0.78 | o | o |
| | 12 | 2 | 5.5 | 0.78 | o | o |

Remark: o no problem
Remark: Δ limit

Table 2 shows that the ratio $N_F/N_S \times W_S$, that is, the ratio of the number of the supporting arms to the number of spokes times the width of the spokes, should be less than 6. Accordingly, although the total number of supporting arms may be any number so long as the above condition is satisfied, the most advantageous number is about 128 from the view point of working, and the preferred number of spokes is 2 to 12. Under these conditions, the moment of inertia of the type head of this invention is smaller than that of the prior art. When the number of the spokes is selected to be within the range specified above it is possible to insert fingers for mounting and dismounting the type head.

Typical examples of the type head 20 are as follows.

EXAMPLE 1

128 type units having dimensions specified by JIC C6250 (OCR B-1) are used. The supporting arms are made of steel sheets having an average thickness of 0.15 mm. The annular rim 24, spokes 25 and the hub 23 are made from sheets of synthetic resin having a mean thickness of 0.2 mm. The number of spokes is 4. The distance between the center of the hub and the outer periphery of the annular rim is 32 mm, the distance between the center of the hub and the outer end of the type unit is 45 mm, and the total weight is about 3g. The moment of inertia is about 30g-cm$^2$. There is no side printing.

EXAMPLE 2

The same data as in Example 1 are used except that the type head as a whole is made from a sheet of synthetic resin having a thickness of about 0.55 mm. The rotational moment of inertia is about 25g-cm$^2$ and is smaller than that of Example 1. Again there is no side printing.

The type heads of Examples 1 and 2 were installed in an ordinary printing machine, and it was found possible to print characters at a higher speed than when using the prior art head, i.e., it was about 30 characters per second faster in each case. When the entire portion of the prior art type head shown in FIG. 1 is made of synthetic resin, its moment of inertia is about 50g-cm$^2$, thus according to this invention the moment of inertia can be reduced to ½ to ⅔ that of the prior art.

Figure 3:
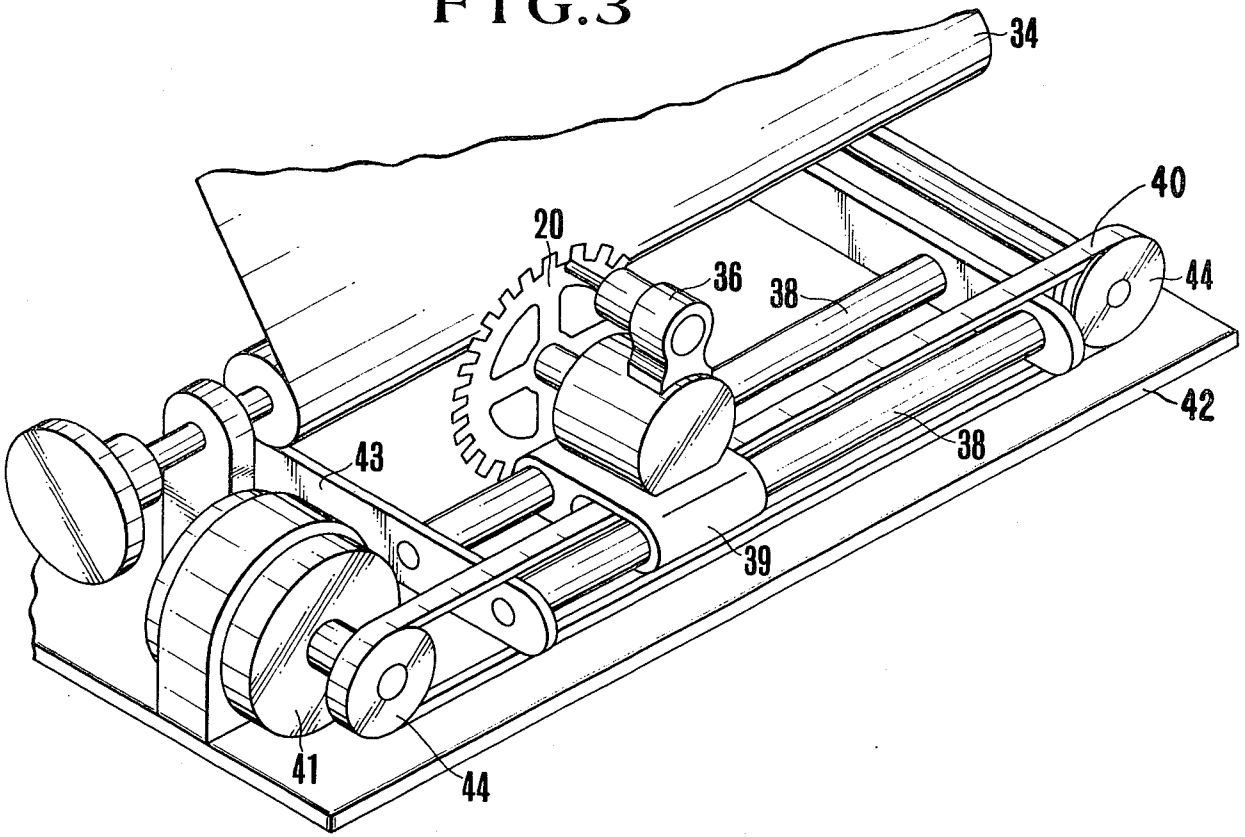
FIG. 3 is a perpsective view of a portion of a motor-controlled printing mechanism equipped with a daisy type head of this invention.
Figure 4:
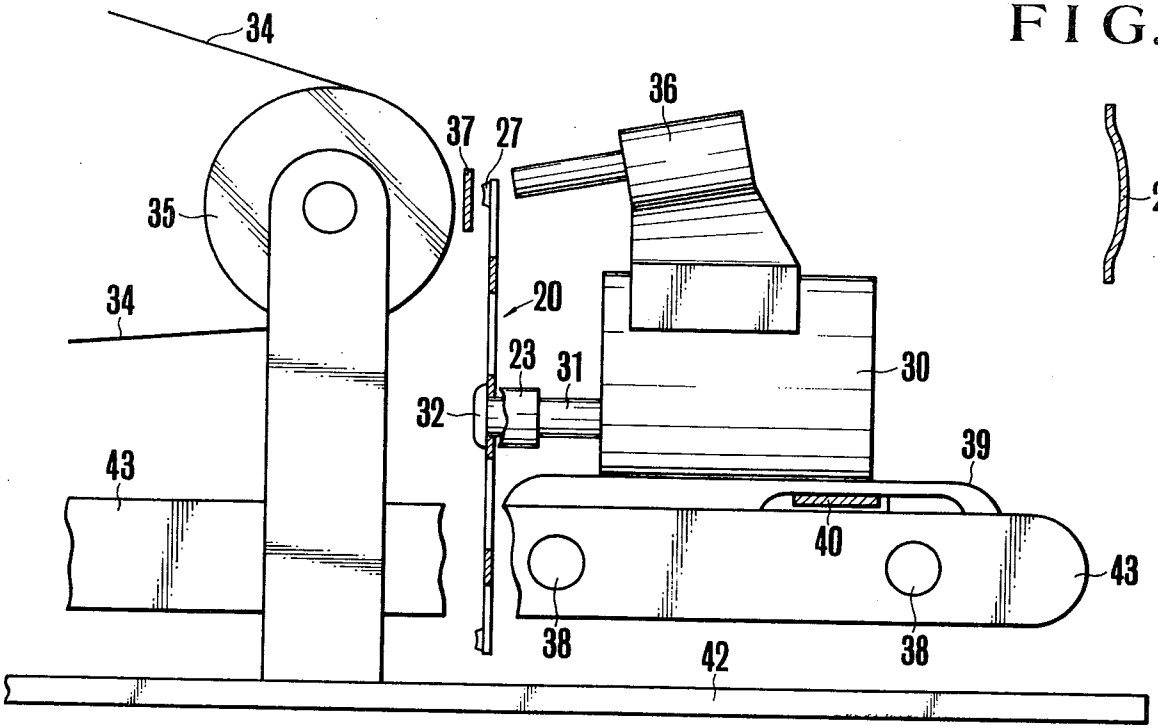
FIG. 4 is a diagrammatic side view showing the relationship between the daisy type head of this invention, a hammer and a driving motor.

FIGS. 3 and 4 show one example of a motor control mechanism of a printing machine equipped with a type head 20 of this invention. As shown, the type head 20 is secured to the shaft 31 of a controlled motor 30, for example a servo-motor or a pulse motor, by means of a bolt 32. The type head 20 is mounted such that its type units 27 oppose a platen 35 wrapped with recording paper 34. A printing hammer 30 is mounted on the housing of the controlled motor 35 to slightly incline with respect to the axis of the shaft 31. When the motor 30 is rotated to rotate the type head 20, the printing hammer 36 is operated when a selected type unit is brought to the printing position for pressing the selected type unit against the printing paper 34 via an inking ribbon 37 thereby printing a character. The controlled motor 30 is mounted on a carriage 39 to be movable along a guide member 38 for moving the type head 20 across the printing paper 34. The carriage 39 is moved by a motor 41 through an endless belt 40 and pulleys 44. The printing machine is mounted on a base 42 and the guide member 38 is carried by a supporting frame 43.

Figure 5:
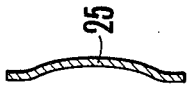
FIG. 5 is a cross-sectional view showing a modification of the spoke of the type head of this invention.

FIG. 5 shows a cross section of a modified spoke 25 taken transverse to its radially extending dimension. As illustrated, a spoke in accordance with this embodiment has a slightly curved contour such that as the sectional secondary moment increases, the strength of the spoke 25 is improved.

It is also possible to bend the annular rim so that it has a transverse cross section similar to that shown in FIG. 5 and as viewed in a tangential direction relative to the rim. Further, it is also possible to construct both of the spokes and the rim to have curved cross sectional configuration.

It should be understood that the invention is not limited to the specific embodiments described above and that many changes and modifications will be obvious to one skilled in the art. For example, the spoke may be made of an angle member. Various dimensions are only illustrative and any suitable dimensions can be selected. Accordingly, it is intended that the appended claims be interpreted as covering all such changes and modifications as fall within the true spirit and scope of the invention.

What is claimed is:

1. A type head comprising a hub, an annular rim encircling the hub in a concentric relationship, a first plurality of equally spaced radial spokes interconnecting said hub and said annular rim, a second plurality, greater than said first plurality, of supporting arms radially extending from said annular rim, and type units mounted on the outer ends of the respective supporting arms, said hub, said rim, said spokes and said arms being combined to form a unitary body.

2. The type head according to claim 1 wherein the number of the spokes is 2 to 12.

3. The type head according to claim 1 wherein $$L_S/L_F/N_F = 0.004 \text{ to } 0.046$$

where $L_S$ is the length of the spokes, $L_F$ is the length of the supporting arms, and $N_F$ is the number of the supporting arms.

4. The type head according to claim 1 wherein each of said spokes is formed with a slight cross-sectional curvature as viewed along to its radially extending dimension.

5. The type head according to claim 1 wherein said annular rim has a curved transverse cross-sectional configuration as viewed in a tangential direction relative to said rim.

6. A rotary type head comprising:

a hub having an outer circumference of a first diameter;

an annular rim encircling the hub in a concentric relationship and having an inner circumference of a second diameter larger than said first diameter and an outer circumference of a third diameter larger than said second diameter;

a first plurality of elongated spokes each having one end rigidly affixed to said hub and another end rigidly affixed to said rim, said spokes being disposed at equally spaced radial intervals about said hub;

a second plurality, greater than said first plurality, of elongated supporting arms, each disposed to have its longitudinal length extending radially outwardly from said rim with one end rigidly affixed to said rim, said hub, said rim, said spokes and said arms being combined to form a unitary body; and a plurality of type units each of which is mounted to the distal end of one of said supporting arms.

7. A rotary type head as recited in claim 6 whereby said hub, said rim, said spokes said arms all lie generally within a common plane normal to the axis of said hub.

8. A type head as recited in claim 6 wherein $$L_S/L_F/N_F = 0.004 \text{ to } 0.046$$

where $L_S$ is the length of the spokes, $L_F$ is the length of the supporting arms, and $N_F$ is the number of the supporting arms.

9. A type head as recited in claim 6 wherein each of said spokes is formed with a slight cross sectional curvature as viewed along to its radially extending dimension.

10. A type head as recited in claim 6 wherein said annular rim has a curved transverse cross-sectional configuration as viewed in a tangential direction relative to said rim.

* * * * *